United States Patent [19]

Simms

[11] Patent Number: 4,659,065

[45] Date of Patent: Apr. 21, 1987

[54] BOLT TENSIONING APPARATUS

[75] Inventor: Graham A. Simms, Wolverhampton, England

[73] Assignee: Hydra-Tight Limited, Walsall, England

[21] Appl. No.: 694,159

[22] Filed: Jan. 23, 1985

[30] Foreign Application Priority Data

Jan. 28, 1984 [GB] United Kingdom ..... 8402326

[51] Int. Cl.[4] ..... B25B 25/00

[52] U.S. Cl. ..... 254/29 A; 81/57.38

[58] Field of Search ..... 254/29 A; 29/252, 262, 29/264, 258, 259, 263, 266; 81/57.38

[56] References Cited

U.S. PATENT DOCUMENTS

| | | | |
|---|---|---|---|
| 1,347,809 | 7/1920 | Frisz et al. | 29/259 |
| 1,429,567 | 9/1922 | Carlisle | 29/262 |
| 1,629,003 | 5/1927 | Schonfeld | 29/264 |
| 3,338,552 | 8/1967 | Persicke | 254/29 A |
| 3,995,828 | 12/1976 | Orban | 254/29 A |
| 4,268,011 | 5/1981 | Randall | 254/29 A |
| 4,302,979 | 12/1981 | Dykmans | 254/29 A |
| 4,391,431 | 7/1983 | Maximov | 254/29 A |

FOREIGN PATENT DOCUMENTS

| | | |
|---|---|---|
| 1310453 | 3/1973 | United Kingdom . |
| 1390012 | 4/1975 | United Kingdom . |
| 1444606 | 8/1976 | United Kingdom . |
| 1469747 | 4/1977 | United Kingdom . |
| 1507606 | 4/1978 | United Kingdom . |
| 2047863 | 12/1980 | United Kingdom . |
| 1582907 | 1/1981 | United Kingdom . |

*Primary Examiner*—Frederick R. Schmidt
*Assistant Examiner*—Steven P. Schad
*Attorney, Agent, or Firm*—Nixon & Vanderhye

[57] ABSTRACT

A hydraulic bolt tensioner in the form of an annular hydraulic jack includes a bridge piece constituted by a plate assembly having at least one support leg which in use serves to transmit the reaction from the piston and cylinder of the jack to hardware associated with the bolt which is to be stressed. The support leg is preferably axially adjustable in length.

6 Claims, 1 Drawing Figure

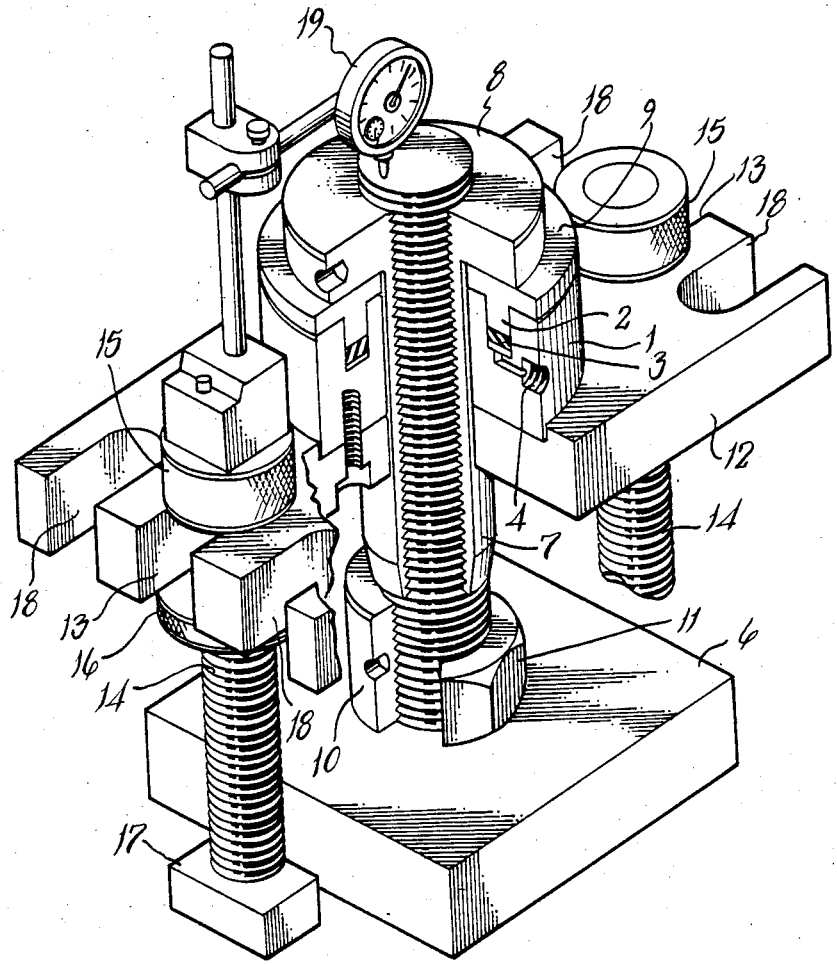
19
8
18
9
15
13
18
2
1
3
15
12
4
14
7
18
13
16
11
6
14
18
10
17

BOLT TENSIONING APPARATUS

FIELD OF THE INVENTION

This invention relates to apparatus for hydraulically stressing a bolt to develop a particular stress in it prior to tightening a nut or other fastener to retain that stress on removal of the stressing force and apparatus. "Bolt" of course includes like members.

THE PRIOR ART

Hydraulic bolt tensioners are well-known. Patent Specifications GB Nos. 991783 and 1590131 describe in considerable detail typical apparatus to which this present invention is applicable. In essence, a bolt tensioner comprises a body portion containing the piston and cylinder parts of what is in fact an annular hydraulic jack. The piston operates against a puller, which is in use screwed down the threads of a bolt extending through the tensioner until it sits on the piston top. The body, or cylinder of the jack is supported by a cylindrical bridge piece, which has a cut-away portion enabling an operative to reach a nut located on the bolt threads below the puller. Access to the nut is limited and it is usual to provide it with a tommy bar hole in each of its flats, so that it can be turned from outside the tool, by hand. Such a bolt tensioner will be termed as being of the kind described.

BRIEF DESCRIPTION OF THE INVENTION

According to the present invention, a bolt tensioner of the kind described is characterised in that the bridge piece is constituted by plate means including at least one support leg which in use serves to transmit the reaction from the piston and cylinder of the tensioner to hardware associated with the bolt which is to be stressed.

PREFERRED FEATURES OF THE INVENTION

The support leg is preferably adjustable in a axial direction and where there is no other available support point (such as the end of an adjacent bolt) there are preferably two support legs disposed on opposite sides of the tensioner. Preferably, the legs are both made axially adjustable. Conveniently they are symmetrically disposed relative to the piston and cylinder part of the tensioner; normally this will mean relative to the axis of the bolt to be stressed. There may in fact be three or even four support legs, but as will shortly become apparent it is very desirable to use as few support legs as possible.

Because the traditional massive bridge piece has been replaced by a very small number of support legs, access to a nut on the bolt threads below the piston/cylinder and the puller is greatly improved, so much so that it is possible to apply conventional torque wrenching techniques to the nut. It is therefore possible to accurately compensate for thread deflection, thread friction and friction between nut face and hardware.

Preferably, a bolt tensioner according to this invention also includes stress measuring means such as a hydraulic load cell between piston and puller and/or strain gauging means. That, coupled with the greatly improved access to the nut, ensures that bolt stressing can be accurately carried out, even in cramped circumstances.

Because the support legs are very few in number and preferably adjustable in length, a bolt tensioner according to this invention can be used for less critical jobs, but where access for a conventional bridge piece is difficult, or impossible. Hitherto it has been necessary to make special asymmetrically shaped bridge pieces for some jobs which can now be handled much more easily with the tensioner of this invention.

DESCRIPTION OF ILLUSTRATED EMBODIMENT

The accompanying darwing is a perspective view of a bolt tensioner according to the invention. In the drawing the bolt tensioner comprises a body portion 1 containing an annular piston and cylinder device 2 provided with an annular seal 3 and a hydraulic fluid port 4. A bolt which is to be tensioned has a screw threaded end portion 5 projecting from some associated hardware (not shown) through a baseplate/washer 6 up through the centre of the bolt tensioner. A puller 7 is screwed down the bolt until its head portion 8 seats against the piston head 9. A nut (round, 10 or hex, 11) is also on the bolt below the puller and abutted against the baseplate 6.

The body portion 1 is supported by a flat plate 12, opposite ends of which are notched at 13 to receive support legs 14. These are screw-threaded to enable their effective lengths to be adjusted by means of knurled ring nuts 15, 16. The legs are each provided with a baseplate 17, thereby providing a further means of effecting a change of length (by changing the baseplates). It will be noted that the plate 12 has four unused notches 18. These enable either the use of one (or more) extra legs, or the use of two legs disposed in a different way, for example two legs along a diagonal through the centre of the tensioner. A dial gauge 19 is mounted on one of the legs to enable bolt end displacement relative to the plate 12 to be determined, so as to give an indication of the stress developed, over and above that indication available from measuring hydraulic fluid pressure. If desired, a hydraulic load cell may be interposed between the piston head 9 and the head 8 of the puller, for a similar purpose. It will be appreciated that such a cell could also be located between the nut (10 or 11) and the baseplate/washer 6. This would be particularly useful for monitoring bolt tension/stress after initial tensioning and subsequent removal of the tensioner.

In operation, the leg length is first adjusted to suit the free length of bolt available. The puller is then run down the bolt until it engages the piston head. The tool is pressurised to give either the desired bolt extension, or to a desired hydraulic pressure, as may be appropriate in the circumstances. The nut (10 or 11) is run down onto the baseplate 6 and tightened against the latter. Because only two support legs are used, access to the nut is easy and it can be tightened as much as is necessary, using for example a torque wrench, spanner or flogging spanner. The bolt tensioner can thereafter be removed by releasing the pressure and unscrewing the puller.

It will be apparent that the same principle can be applied to simultaneously stressing a whole series of bolts, using a tensioner on each bolt.

I claim:

1. A hydraulic bolt tensioner for applying stress to a bolt including, in combination:

an annular hydraulic jack having a piston and a cylinder, puller means for attaching to the threads of the bolt to be tensioned, in use the piston operating against the puller means, and a bridge assembly for supporting the hydraulic jack cylinder, the bridge assembly having an opening associated therewith enabling access to a nut located on the bolt threads below the puller, the bridge assembly constituted by plate means having opposing sides and including a plurality of outwardly directed notches on each of said opposing sides of the plate means for receiving support leg means adapted to be disposed in different alternative configurations, at least two support leg means symmetrically disposed relative to the piston and cylinder part of the tensioner, each of said support legs provided with baseplate means and at least one of said support leg means being axially-adjustable, the support leg means transmitting the reaction from the piston and cylinder of the bolt tensioner to hardware associated with the bolt which is to be stressed, and providing improved access to the nut on the bolt threads below the puller, said bolt tensioner further including means for measuring the tension developed in the bolt.

2. The bolt tensioner according to claim 1 having three support legs symmetrically disposed relative to the piston and cylinder part of the tensioner.

3. The bolt tensioner according to claim 1 having four support legs symmetrically disposed relative to the piston and cylinder part of the tensioner.

4. The bolt tensioner according to claim 1 wherein the means for measuring tension includes means for measuring bolt extension.

5. The bolt tensioner according to claim 1 wherein the means for measuring tension includes means for measuring stress developed in the bolt.

6. The bolt tensioner according to claim 1 wherein the means for measuring tension includes means for measuring bolt extension and stress developed in the bolt.

* * * * *